US008201510B1

(12) United States Patent
Engling et al.

(10) Patent No.: US 8,201,510 B1
(45) Date of Patent: Jun. 19, 2012

(54) COLLAPSIBLE SAIL FRAME FOR WATERCRAFT

(76) Inventors: Charles W. Engling, Stuart, FL (US); Debra L. Engling, Stuart, FL (US)

( * ) Notice: Subject to any disclaimer, the term of this patent is extended or adjusted under 35 U.S.C. 154(b) by 238 days.

(21) Appl. No.: 12/617,798

(22) Filed: Nov. 13, 2009

Related U.S. Application Data

(60) Provisional application No. 61/114,583, filed on Nov. 14, 2008.

(51) Int. Cl.
*B63B 35/00* (2006.01)

(52) U.S. Cl. ..... 114/39.22

(58) Field of Classification Search ..... 114/39.21, 114/39.22, 39.29, 39.31, 39.32, 102.1–102.19, 114/102.2–102.22, 108, 109, 113–115
See application file for complete search history.

(56) References Cited

U.S. PATENT DOCUMENTS 2,559,421 A * 7/1951 Garrett ..... 248/515
4,276,033 A * 6/1981 Krovina ..... 440/8
4,704,979 A * 11/1987 Ammen et al. ..... 114/98
5,642,683 A * 7/1997 Bedford ..... 114/102.1

* cited by examiner

*Primary Examiner* — Daniel Venne
(74) *Attorney, Agent, or Firm* — Glenn E. Gold; H. John Rizvi; Gold & Rizvi, P.A.

(57) ABSTRACT

A collapsible sail frame for a watercraft. The sail frame includes a shaft, a skeletal assembly, and a sail. The shaft has a tip and a handle. The skeletal assembly includes ribs, struts, a first ring and a second ring. The sail is attached on the ribs. First pivoting joints connect ribs to the first ring, with ribs extending in a radial pattern. Second pivoting joints connect struts to the second ring. Third pivoting joints connect struts to ribs. The first ring is fixed on the shaft and the second ring is slidably mounted on the shaft so as to be manually operable for deploying the skeletal assembly, to spread the sail. A loop is provided on the deck of the watercraft, for retaining the tip of the shaft and the handle includes a clamp for engaging the deck of the watercraft.

18 Claims, 6 Drawing Sheets

COLLAPSIBLE SAIL FRAME FOR WATERCRAFT

CROSS-REFERENCE TO RELATED APPLICATION

This Non-Provisional Utility application claims the benefit of U.S. Provisional Patent Application Ser. No. 61/114,583, filed on Nov. 14, 2008, which is incorporated herein in its entirety.

BACKGROUND OF THE INVENTION

1. Field of the Invention

The present invention generally relates to sails for watercraft and particularly to a collapsible sail frame, which may be attached to a watercraft, for spreading and supporting a sail to catch wind and propel the watercraft.

2. Description of the Prior Art

Recreational boaters often transport watercraft on rooftop carriers designed to fit on the top of conventional private automobiles and vans. Boaters enjoy the convenience of being able to load a watercraft onto a rooftop carrier and travel to launching points at a variety of parks or other areas where water access is available. The use of relatively small and lightweight watercraft makes it possible for a boater to transport the watercraft and accessory equipment to a number of different areas where recreational boating may be enjoyed. Relatively small and lightweight watercraft, such as canoes and kayaks, are most popular for this type of boating, because they may be easily stored at a residence and transported to the launching area. Canoes and kayaks are typically propelled by paddling and require minimal accessory equipment, which adds to the convenience of their use.

Some boaters desire to add a sail as an auxiliary means of propelling the watercraft. Various designs of sailing apparatus are available but most require a mast, or other hardware, and some standing rigging to support a sail. The additional equipment is a burden to store, and transport with the watercraft. When boating, a mast, sail, and standing rigging are cumbersome to strike and stow when a user desires to propel the watercraft by paddling only.

There is a need for a small, simple, and convenient sail frame, which can be stowed, when not in use, and can be deployed to spread and support a sail for downwind sailing, on a canoe or kayak.

There is a need for a compact collapsible sail frame which can be conveniently stored and transported with other boating accessories.

There is a need for a collapsible sail frame on a watercraft which can be quickly and easily installed and removed.

SUMMARY OF THE INVENTION

The present in invention is directed to a collapsible sail frame for a watercraft. The sail frame is designed for small watercraft normally propelled by paddling and provides an auxiliary sail, which can be conveniently transported with other accessory equipment. The sail frame includes a shaft having a forward end and an aft end, a skeletal assembly, and a sail. A handle assembly extends from the aft end of the shaft and a tip projects from the forward end of the shaft. The skeletal assembly includes a plurality of ribs, a plurality of struts, a tip bracket, and a central bracket, all being interconnected by pivoting joints. The tip bracket is fixed on the shaft proximate to the forward end and the central bracket is slideably mounted on the shaft so as to be manually operable for advancing toward the tip bracket to effect a transition of the skeletal assembly from a stowed configuration to a deployed configuration. The sail is disposed adjacent to the ribs and is attached to the ribs.

The watercraft includes a deck fitting, for receiving and releasably retaining the tip. The handle assembly includes a clip means for engaging the deck, or other structural member, of the watercraft. The tip may be engaged in the deck fitting, the clip means may be engaged on the deck, or other structural member, and the central bracket may be advanced toward the tip bracket to deploy the sail frame and spread the sail to catch wind and propel the watercraft downwind. The central bracket may be retracted away from the tip bracket to stow the sail frame, as desired. The sail frame may be removed by releasing the clip means and disengaging the tip from the deck fitting. In the stowed configuration, the sail frame may be easily transported.

It is an object of the present invention to provide a compact collapsible sail frame, for a small watercraft.

It is another object of the present invention to provide a collapsible sail frame which can be quickly and easily stowed and deployed without detachment from the watercraft.

It is a further object of the present invention to provide a collapsible sail frame which can be quickly and easily installed on the watercraft and may also be quickly and easily removed.

These and other aspects, features, and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawings, in which.

Like reference numerals refer to like parts throughout the various views of, the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, where applicable, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the drawings, the present invention is directed toward a collapsible sail frame designed to be releasably installed on a manually propelled watercraft, such as a canoe or kayak. The sail frame is adapted to be selectively deployed to spread and support a downwind sail.

Figure 1:
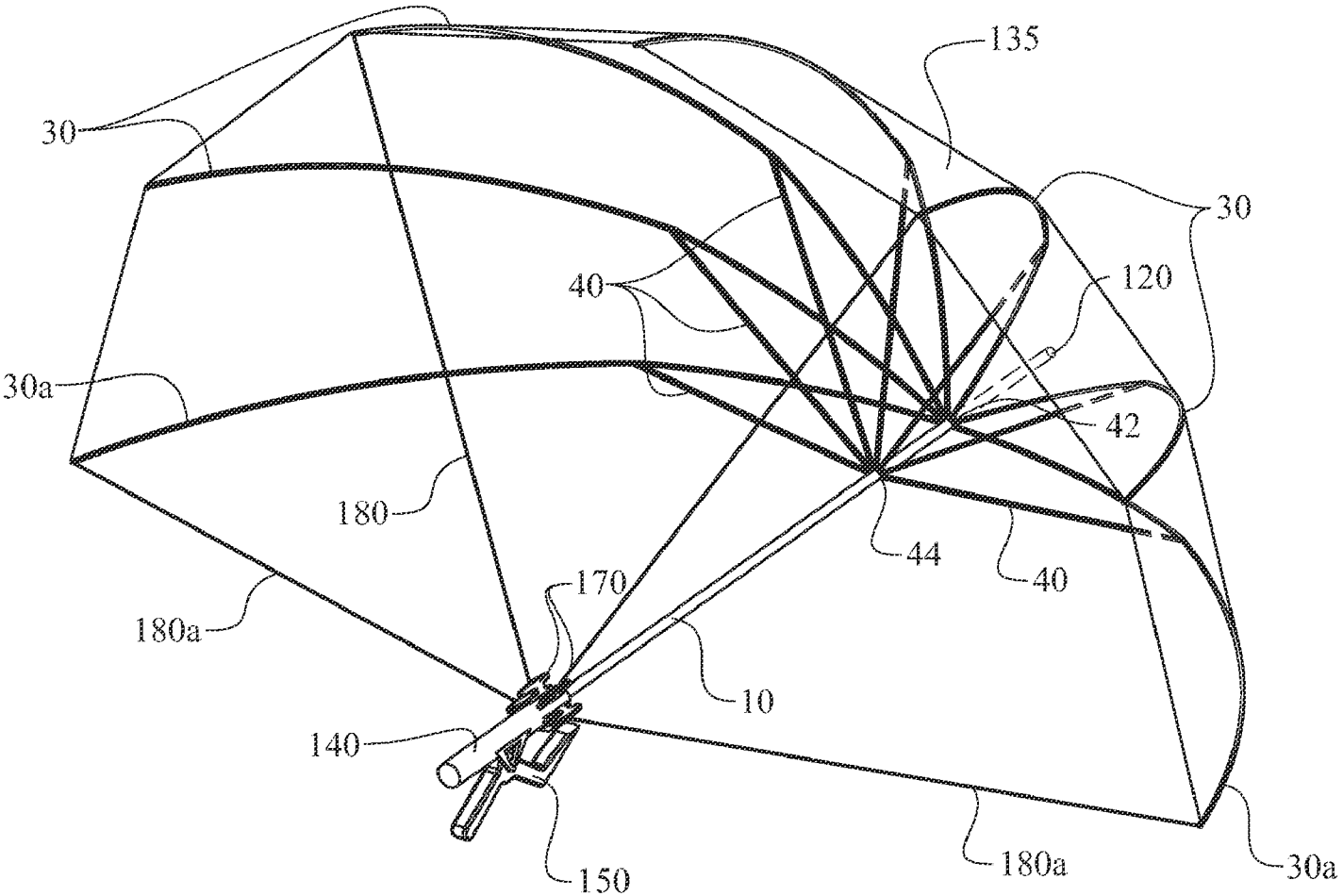
FIG. 1 is a perspective view of the sail frame of the present invention.
Figure 2:
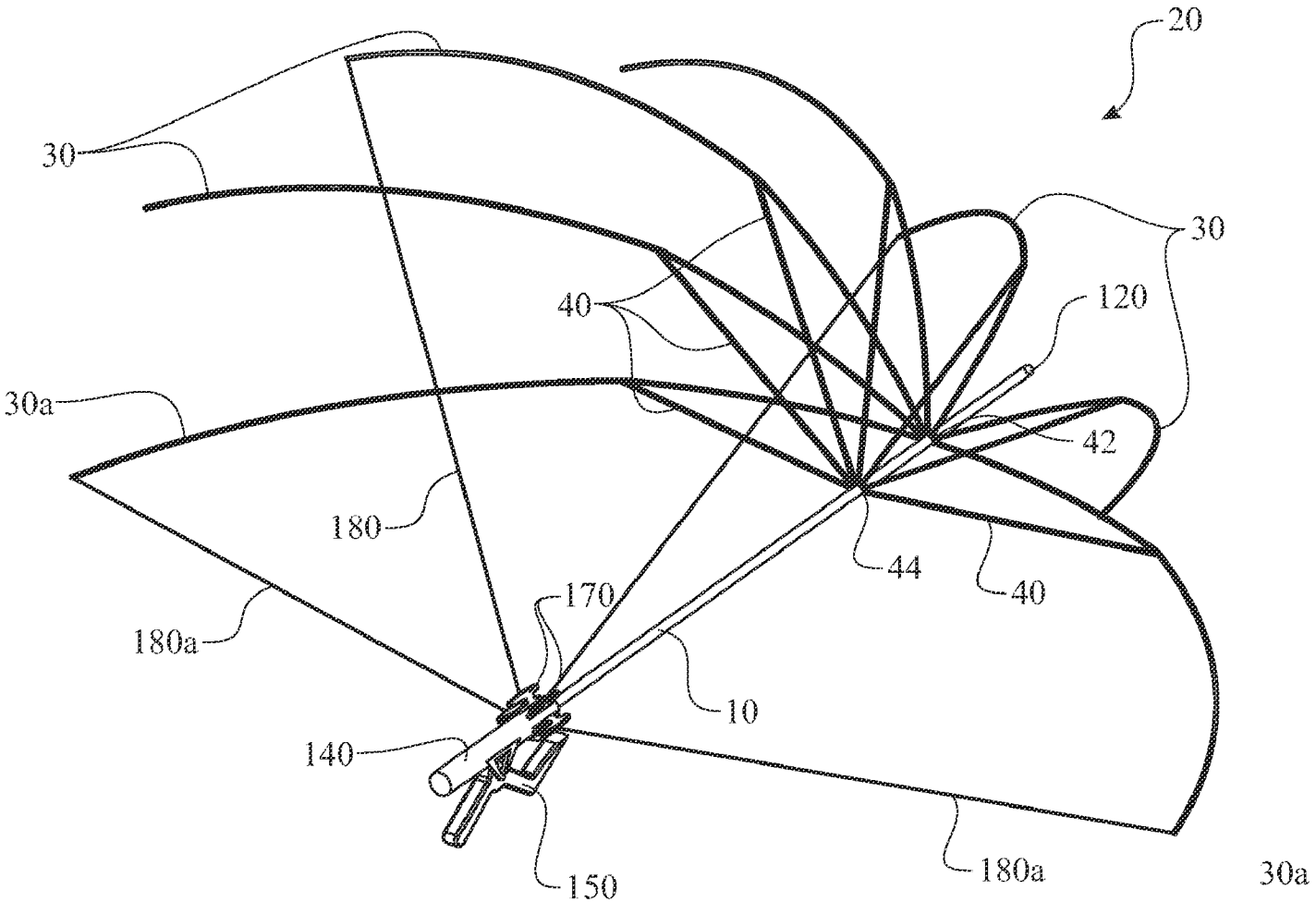
FIG. 2 is a perspective view of the skeletal assembly of the sail frame, of the present invention.
Figure 3:
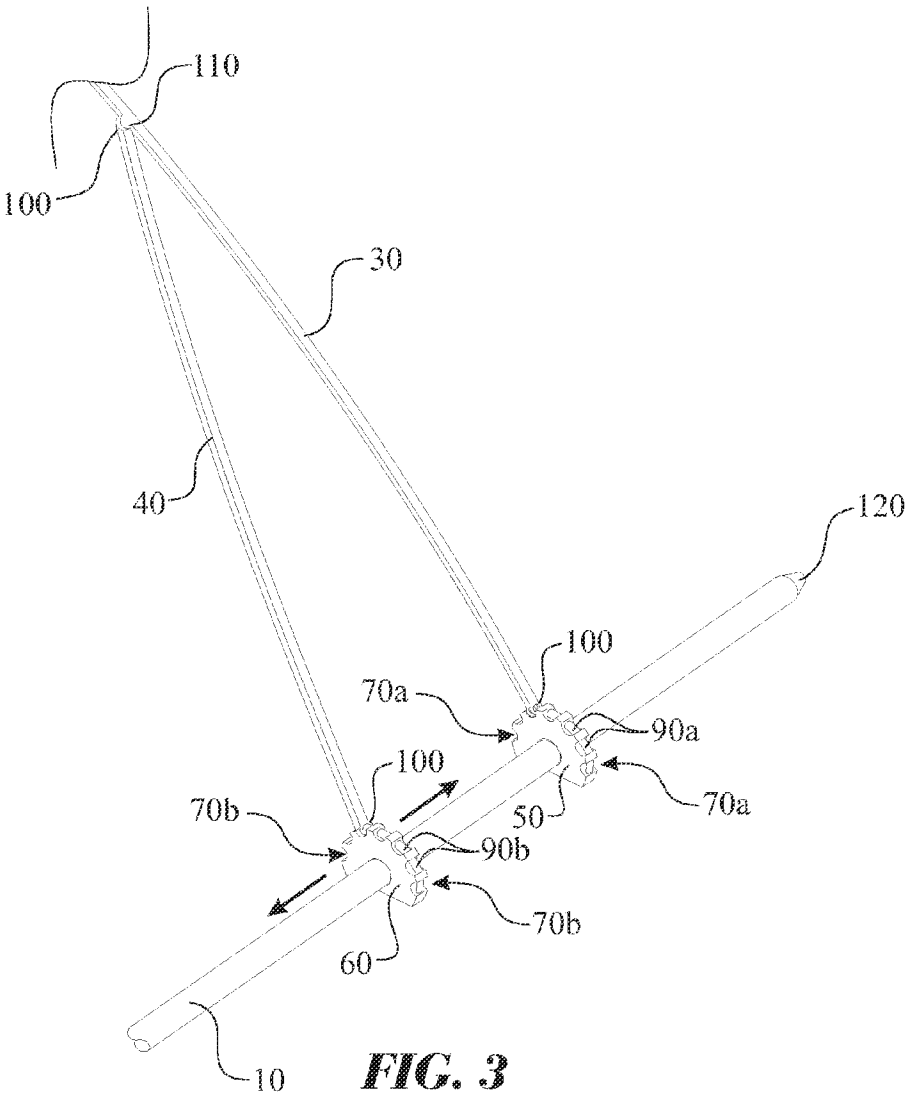
FIG. 3 is a close-up perspective view of the forward end portion of the shaft and skeletal assembly of the sail frame, of the present invention, with all but one rib and strut eliminated from the view, for clarity.

The collapsible sail frame, shown in FIG. 1, includes a shaft 10 and a skeletal assembly 20, as shown in FIG. 2. The skeletal assembly 20, includes a plurality of ribs 30, a plurality of struts 40, tip bracket 42, and central bracket 44, all being interconnected by pivoting joints. Interconnection of the skeletal assembly 20 is preferably provided by first pivots, disposed in a semi-circular array on the tip bracket 42, second pivots, disposed in a semi-circular array on the central bracket 44, and third pivots, disposed on the ribs 30. Tip bracket 42 and central bracket 44 are preferably a first ring 50 and second ring 60, respectively, as shown in FIG. 3. The first and second pivots preferably consist of first transverse channels 70*a* on the first ring 50 and second transverse channels 70*b* on the second ring 60, bridged by first rods 90*a* on the first ring 50 and second rods 90*b* on the second ring 60. Each of the ribs 30 includes a proximal end having a planar tongue 100 with a through hole for receiving one of the first rods 90*a* to retain the ribs 30 and allow free pivoting movement about axes defined by the first rods 90*a*, forming first pivoting joints. The ribs 30 extend in a radial pattern from the shaft. Each of the struts 40 includes a first end having a planar tongue 100 with a through hole for receiving one of the second rods 90*b* for joining each of the struts 40 to one of the second rods 90*b*, in pivoting relation, forming second pivoting joints. It is preferred that the first and second transverse channels 70*a* and 70*b* be of a width selected to closely confine the ribs 30 and struts 40 to minimize rotational movement about an axis defined by the shaft 10 but of sufficient width to allow rotation about the first and second transverse rods 90*a* and 90*b*. The third pivots preferably consist of double flanges 110. A second end of each of the struts 40 also includes a planar tongue 100 with a through hole designed to align with a pair of holes provided in the double flanges 110, which are situated at an intermediate location on each of the ribs 30. A rivet (not shown) is preferably secured in the aligned holes to join each of the ribs 30 to one of the struts 40, in pivoting relation, forming the third pivoting joints. It is preferred that the double flanges 110 have a width selected to minimize lateral movement of the struts 40 but sufficient width to allow rotation about the rivets.

Figure 4:
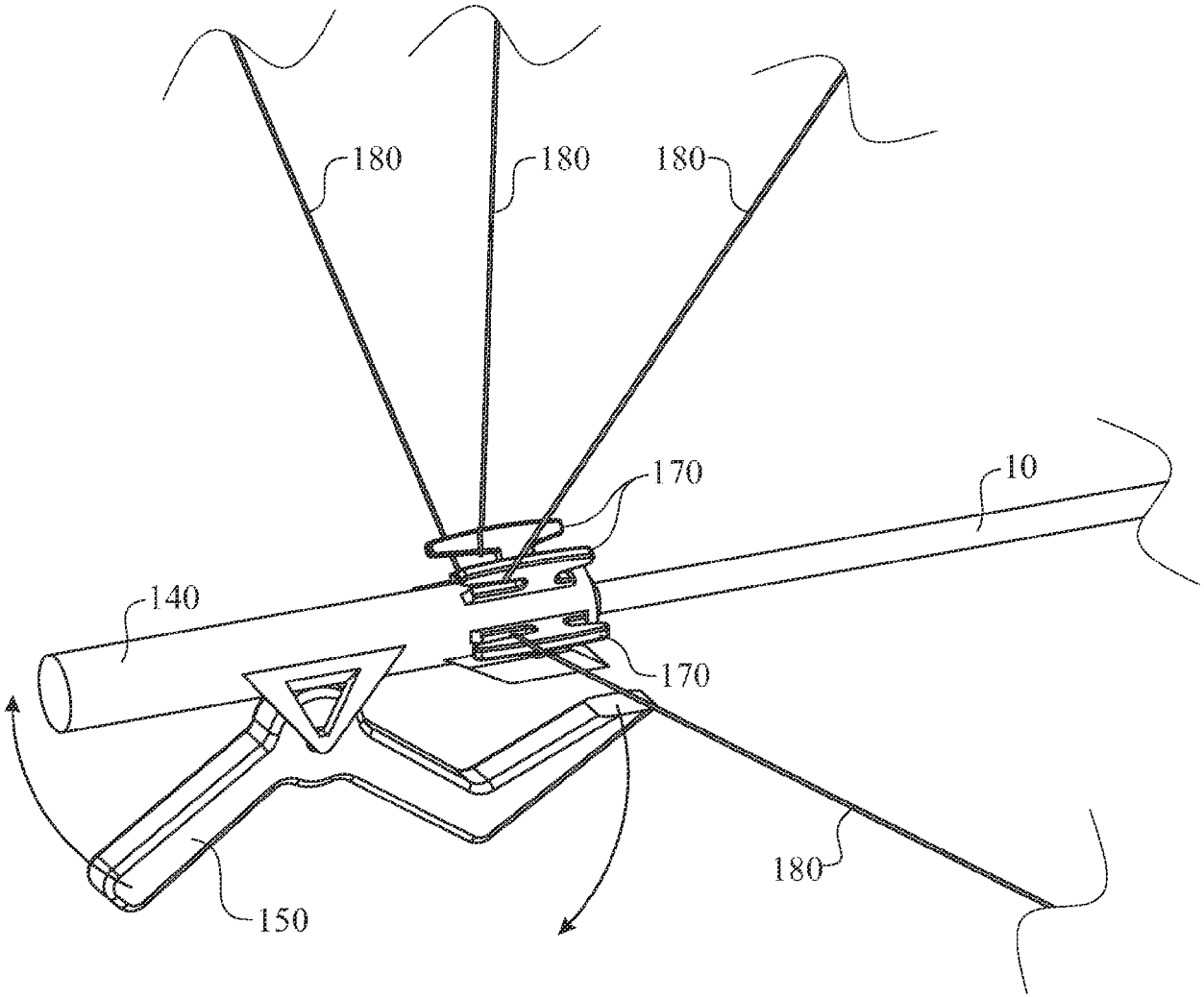
FIG. 4 is a close-up perspective view of the aft end of a portion of the shaft of the sail frame, showing the handle assembly.

The shaft 10, as shown in FIGS. 1 and 2, includes a forward end, having a projecting tip 120, shown in detail in FIG. 3, and an aft end, which includes a handle assembly, shown in detail in FIG. 4. Returning to FIG. 3, the shaft 10 is received through the second ring 60 and through the first ring 50. The first ring 50 is fixed to the shaft 10 at a point proximate to the forward end to secure the skeletal assembly 20 on the shaft 10. The second ring 60 is slideably mounted on the shaft 10 at an intermediate location. It is preferred that the second ring 60 be manually operable for sliding, as indicated by the arrows in FIG. 3, to advance toward the first ring 50, for a deployed configuration of the skeletal assembly 20, or to retract away from the first ring 50 for a stowed configuration of the skeletal assembly 20. FIG. 3 shows one rib and strut combination but it is intended that each of the first pivots retain a rib and each of the second pivots retain a strut. It will be appreciated that advancing the second ring 60 toward the first ring 50 will spread the ribs 30 in a radiating semi-circular pattern extending from the shaft 10 and that retracting the second ring 60 away from the first ring 50 will collapse the ribs 30 in alignment with and approximately adjacent to the shaft 10, in the nature of the operation of a conventional umbrella. It is preferred that a spring biased releasable lock (not shown), be included on the shaft 10, for releasably locking the skeletal assembly 20 in the deployed configuration, in the manner of a conventional umbrella. A sail 135, shown in FIGS. 1 and 5, formed of fabric, and preferably transparent, is spread adjacent to the ribs 30 to substantially cover the radiating semi-circular or quarter-spherical pattern and attached by sewing, gluing or other conventional means.

Figure 5:
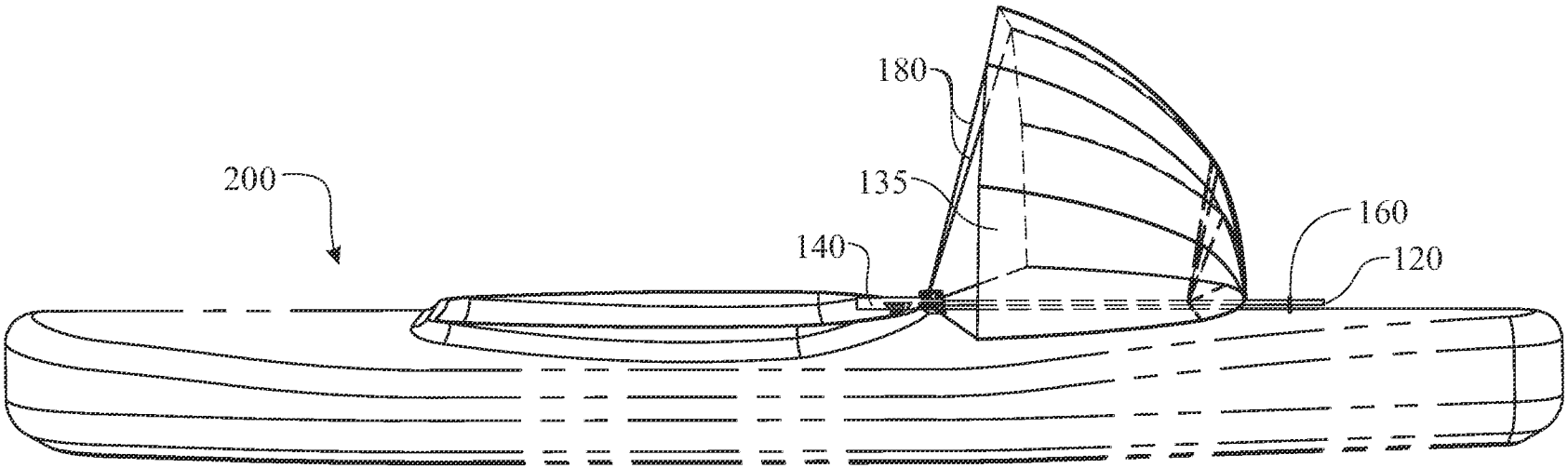
FIG. 5 is a side perspective view of a kayak with the sail frame of the present invention in deployed configuration.
Figure 6:
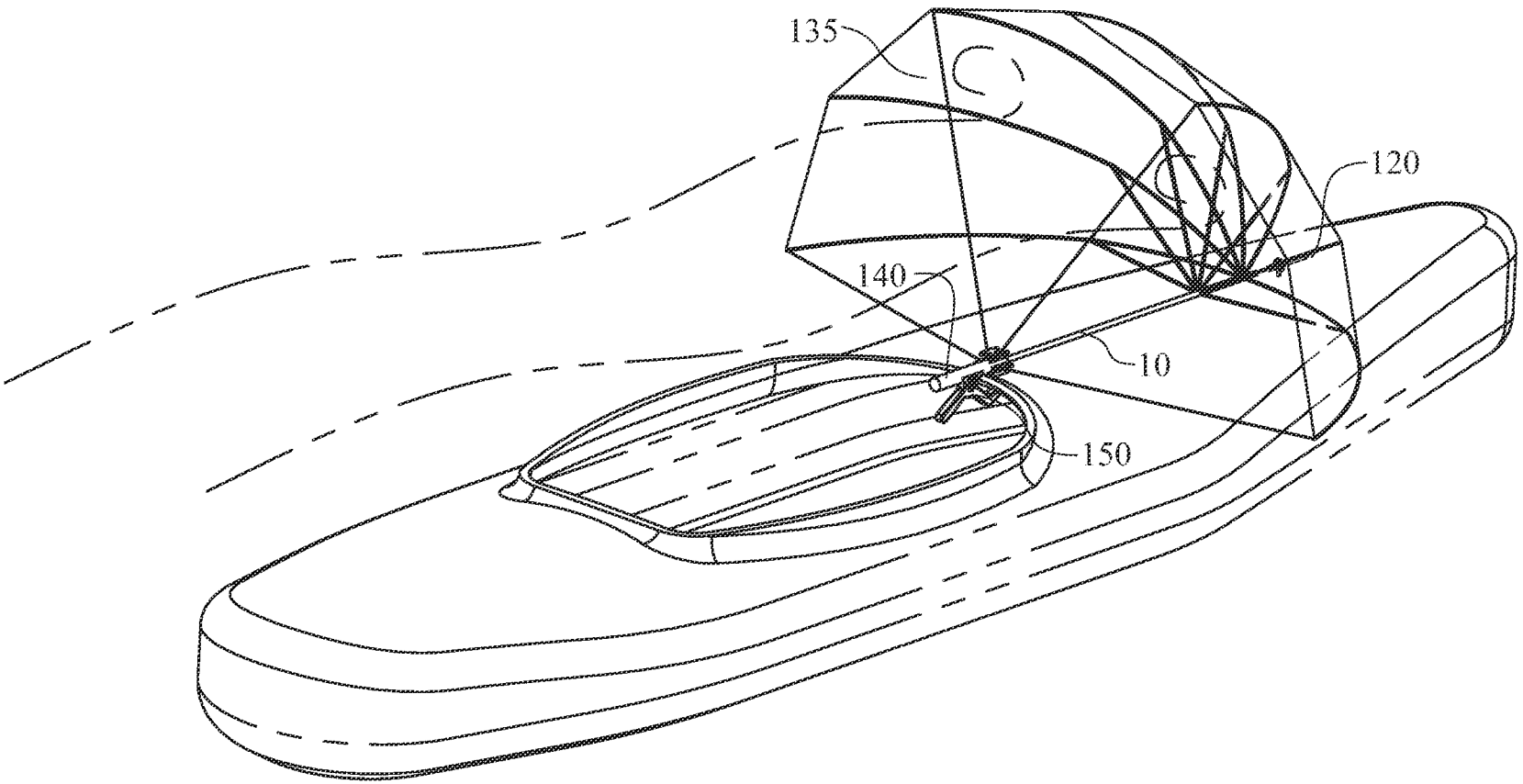
FIG. 6 is a rear perspective view of a kayak with the sail frame of the present invention in deployed configuration.

The handle assembly, as shown in FIG. 4, preferably includes a handle 140, for lifting and carrying the sail frame, and clip means, such as a spring biased clamp 150, for releasably attaching the sail frame to the deck, or other structural member, of a watercraft 200. The clip means may consist of other fasteners or ties of conventional design. In order to use the sail frame most effectively, it is intended that the watercraft 200 include a catch means, such as a loop 160 formed of line attached to the deck proximate to the bow, as shown in FIG. 5. In use, the tip 120 may be inserted into the loop 160 and the clamp 150 may be engaged on the deck of a kayak, as shown in FIG. 6. It will be appreciated that in a watercraft 200, such as a canoe, the clamp 150 may be engaged on a thwart or another structural member. When a downwind sail is needed, the user may advance the second ring 60 to deploy the skeletal assembly 20 and spread the sail 135 to catch the wind and propel the watercraft 200. When no longer needed, the sail frame may be stowed by retracting the second ring 60. The sail frame may remain on the watercraft 200 in the stowed or deployed configuration. The sail frame may be removed by releasing the clamp 150 and drawing the tip 120 out of the loop 160.

The shaft 10 is preferably formed of tubular steel, aluminum, or other light metal alloy. The skeletal assembly 20 is preferably constructed of flexible and resilient metal, such as steel, or plastic. The handle 40 may preferably be formed of wood or plastic, and may be molded to the shaft 10. The entire sail frame, may be constructed as a conventional collapsible umbrella, with similar materials and design; however, other known materials and design configurations may be used to provide a generally semi-circular pattern of radial members, in a collapsible frame, all of which would fall within the scope of the present invention.

It is preferred that the handle assembly further include a plurality of cleats 170 mounted on the handle 140, as shown in FIGS. 2 and 4. A plurality of sheets 180, formed of line may be attached, by tying or other means, to the distal ends of one or more or the ribs 30 and each of the sheets 180 may be releasably secured to one of the cleats 170, so that a user may selectively adjust the tension on the various sheets 180 to shape the sail frame for more advantageously catching the wind. The ribs 30 can be interial or considered as base ribs 30*a*, wherein the base ribs 30*a* are provided about a periphery of said sail 135. Base sheets 180*a* would be attached via an attachment point to a free end of the base ribs 30*a* and a second attachment point being attached to one of the at least one cleats 170. The base sheets 30*a* are provided for controlling the shape of the base ribs 30*a*. These can be used to manage any excessive airflow through a lower opening of said sail 135. The various sheets 180 are provided to adjust the exposed area of the sail 135 for gathering wind and propelling the watercraft 200.

While the preferred embodiments of the invention have been described above, it will be recognized and understood that various modifications can be made in the invention and the appended claims are intended to cover all such modifications which may fall within the spirit and scope of the invention.

What is claimed is:

1. A collapsible sail frame for a watercraft comprising:

a shaft having a forward end and an aft end;

a skeletal assembly, and;

a sail;

said shaft having a handle assembly extending from said aft end, and a tip projecting from said forward end;

said skeletal assembly including a plurality of ribs, a plurality of struts, a tip bracket, and a central bracket;

said ribs, struts, tip bracket, and central bracket being interconnected by a plurality of pivoting joints;

said tip bracket being fixed on said shaft proximate to said forward end;

said central bracket being slideably mounted on said shaft and being manually operable for advancing toward said tip bracket to effect a transition of said skeletal assembly from a stowed configuration to a deployed configuration;

said watercraft including a deck fitting for receiving said tip;

said handle assembly including a clip for engaging said handle assembly with a structural member of said watercraft;

said sail being disposed adjacent to said ribs and being attached to said ribs;

whereby said tip may be engaged in said deck fitting, said clip may be engaged with said watercraft structural member, said central bracket may be advanced to spread said sail to catch wind and propel said watercraft.

2. The collapsible sail frame of claim 1, wherein, said tip bracket comprises a first ring including a plurality of first pivots disposed in an array approximately defining a semi-circle;

said central bracket comprises a second ring including a plurality of second pivots disposed in an array aligned with said first pivots;

each of said ribs having one of a set of third pivots disposed at an intermediate location;

each of said ribs having a proximal end pivotally connected to one of said first pivots;

said struts having a first end pivotally connected to said second pivots and a second end pivotally connected to said third pivots.

3. A sail frame as recited in claim 2, wherein, said first pivots and said second pivots each include a channel bridged by a transverse rod;

said third pivots each include a double flange spanned by a rivet;

said proximal ends of said ribs, and said first ends of said struts, are connected to said second pivots by providing a tongue having a through hole, for receiving one of said rods;

said second ends of said struts being connected to said third pivots by providing a tongue having a through hole, for receiving said rivets;

said shaft including catch means adapted for releasably locking said central bracket in said deployed configuration.

4. A sail frame as recited in claim 1, the sail frame comprising:

a plurality of cleats mounted on said handle;

a plurality of sheets, each fixed to a distal end of one of said ribs and releasably secured to one of said cleats;

whereby tension on said sheets may be selectively adjusted to alter the shape and position of the sail frame to more advantageously catch the wind.

5. A sail frame as recited in claim 1, wherein said sail is fabricated of a transparent material.

6. A process for providing auxiliary sail power to a watercraft comprising the steps of:

providing a shaft having a forward end and an aft end;

providing a skeletal assembly, and;

providing a sail;

said shaft having a handle assembly extending from said aft end, and a tip projecting from said forward end;

said skeletal assembly including a plurality of ribs, a plurality of struts, a tip bracket, and a central bracket;

said ribs, struts, tip bracket, and central bracket being interconnected by a plurality of pivoting joints;

said tip bracket being fixed on said shaft proximate to said forward end;

said central bracket being slideably mounted on said shaft and being manually operable for advancing toward said tip bracket to effect a transition of said skeletal assembly from a stowed configuration to a deployed configuration;

said watercraft including a deck fitting for receiving said tip;

said handle assembly including a clip for engaging said handle assembly with a structural member of said watercraft;

said sail being disposed adjacent to said ribs and being attached to said ribs;

engaging said tip in said deck fitting;

engaging said clip with said watercraft structural member;

advancing said central bracket to spread said sail to catch wind and propel said watercraft.

7. A process for providing auxiliary sail power to a watercraft as recited in claim 6, the process further comprising the steps of:

providing a plurality of cleats mounted on said handle;

providing a plurality of sheets, each fixed to a distal end of one of said ribs and releasably secured to one of said cleats;

selectively adjusting tension on said sheets to alter the shape and position of the sail frame to more advantageously catch the wind.

8. A process for providing auxiliary sail power to a watercraft as recited in claim 6, wherein:

said tip bracket comprises a first ring including a plurality of first pivots disposed in an array approximately defining a semi-circle;

said central bracket comprises a second ring including a plurality of second pivots disposed in an array aligned with said first pivots;

each of said ribs having one of a set of third pivots disposed at an intermediate location;

said pivoting joints including first pivoting joints, second pivoting joints, and third pivoting joints;

each of said ribs having a proximal end pivotally connected to one of said first pivots;

said struts having a first end pivotally connected to said second pivots and a second end pivotally connected to said third pivots.

9. A process for providing auxiliary sail power to a watercraft as recited in claim 8, wherein:

said first pivots and said second pivots each include a channel bridged by a transverse rod;

said third pivots each include a double flange spanned by a rivet;

said proximal ends of said ribs and said first ends of said struts are connected to said pivots by providing a tongue having a through hole, for receiving one of said rods;

said second ends of said struts are connected to said pivots by providing a tongue having a through hole, for receiving one of said rivets;

said shaft including catch means adapted for releasably locking said central bracket in said deployed configuration.

10. A process for providing auxiliary sail power to a watercraft as recited in claim 6, the process further comprising a step of providing visibility via a transparent sail.

11. A collapsible sail frame for a watercraft comprising:

a shaft having a forward end and an aft end;

a skeletal assembly, and;

a sail;

at least one cleat provided on said shaft, proximate said aft end;

said skeletal assembly having a plurality of ribs, a plurality of struts, a tip bracket, and a central bracket;

said ribs, struts, tip bracket, and central bracket being interconnected by a plurality of pivoting joints;

said tip bracket being fixed on said shaft proximate to said forward end;

said central bracket being slideably mounted on said shaft and being manually operable for advancing toward said tip bracket to effect a transition of said skeletal assembly from a stowed configuration to a deployed configuration;

said sail being disposed adjacent to said ribs and being attached to said ribs providing said sail in said quarter-spherical shape; and at least one sheet provided having a first attachment point secured to a free end of at least one of the ribs and a second attachment point secured to one of the at least one cleats, wherein the at least one sheet is provided to adjust a shape of the respective rib.

12. A collapsible sail frame as recited in claim 11, said sail frame further comprising:

a tip projecting from said forward end.

13. A collapsible sail frame as recited in claim 12, said sail frame further comprising:

a deck fitting attachment to said watercraft for receiving said tip.

14. A collapsible sail frame as recited in claim 11, said sail frame further comprising:

a handle assembly disposed upon said shaft, proximate said aft end.

15. A collapsible sail frame as recited in claim 14, said sail frame further comprising:

said handle assembly including a clip for engaging said handle assembly with a structural member of said watercraft.

16. A collapsible sail frame as recited in claim 15, said sail frame further comprising:

a tip projecting from said forward end; and a deck fitting attachment to said watercraft for receiving said tip, whereby said tip may be engaged in a deck fitting, said clip may be engaged with said structural member, said central bracket may be advanced to spread said sail to catch wind and propel said watercraft.

17. A collapsible sail frame as recited in claim 11, said sail frame further comprising:

a pair of base ribs defining an edge of said sail about a plane substantially parallel with said shaft a pair of base sheets provided having a first attachment point secured to a free end of said respective base rib and a second attachment point secured to one of the at least one cleats, wherein the at base sheet provided to adjust a shape of the respective base rib.

18. A collapsible sail frame as recited in claim 11, wherein said sail is fabricated of a transparent material.

* * * * *